US006468074B1

(12) United States Patent
Wu

(10) Patent No.: US 6,468,074 B1
(45) Date of Patent: Oct. 22, 2002

(54) ROTARY KILN FOR CALCINATION OF LIGHT AGGREGATE CEMENT

(76) Inventor: Chieh-Yuan Wu, 3F, No. 38, Lane132, Sec 2, Ta-An Rd., Ta-An Area, Taipei (TW)

( * ) Notice: Subject to any disclaimer, the term of this patent is extended or adjusted under 35 U.S.C. 154(b) by 0 days.

(21) Appl. No.: 09/896,290

(22) Filed: Jun. 29, 2001

(51) Int. Cl.[7] ..... F27B 7/02

(52) U.S. Cl. ..... 432/103; 432/104; 432/105; 432/106; 432/110

(58) Field of Search ..... 432/103, 104, 432/105, 106, 110

(56) References Cited

U.S. PATENT DOCUMENTS 3,584,850 A * 6/1971 Brandvold et al. ..... 106/753

3,938,949 A * 2/1976 Christiansen ..... 432/106

FOREIGN PATENT DOCUMENTS

JP 408126839 A * 5/1996

* cited by examiner

*Primary Examiner*—Jiping Lu
(74) *Attorney, Agent, or Firm*—Ostrolenk, Faber, Gerb & Soffen, LLP

(57) ABSTRACT

A rotary kiln for calcination of light aggregate cement comprises a calcination kiln body, a heavy-oil combustion device, and a cooling device, wherein the calcination kiln body is formed in a U-turn for saving construction site and is composed of a feeding entrance at its upmost end, a product exit at the lowest end, and a plurality of revolving segments varied in caliber by segment so as to raise the calcination efficiency, save construction expenditure, and meet environment requirements.

6 Claims, 4 Drawing Sheets

ROTARY KILN FOR CALCINATION OF LIGHT AGGREGATE CEMENT

BACKGROUND OF THE INVENTION

Light aggregate cement is known having specialties in light specific gravity, high strength, heat insulating, sound silencing, waterproofness, fire resistance, workable duration, volume stability, etc., and is considered advantageous and economic in building construction.

The specific gravity of the light aggregate cement is so light as about ⅔ (or down) as that of the generic natural aggregate cement, the bearing capability of a building foundation is possibly descended to some reasonable extent. Moreover, in view of the fact that Taiwan is located in the quake-swarm zone along the pacific shore and the seismic energy is propagated in proportion to the total weight of a building, the light aggregate cement is obviously more favorable for lessening the seismic energy propagation and alleviating demolition of the building accordingly.

Besides, as the light aggregate to be applied in cement has been calcined in advance at temperature as high as 1200° C., hence it becomes an incombustible with high insulating capability and low thermal conductivity so that spontaneous combustion would scarcely be caused at the higher stores of a building via thermal conduction in the case a fire is raging in the lower stores. In addition, because the light aggregate is self-shrinking slightly in high temperature, floor cambering or sinking or burst of cement due to expansion would hardly happen on the spot of a conflagration, therefore, it is favorable in prevention of destroy of a structure body and in protection of a fireman against being injured by falling articles.

Basing on abovesaid merits, the light aggregate cement is now widely implemented in civil or building construction, however, the light aggregate material is not collectable whenever desired until recently the related calcination technology is gradually matured. In building a calcination kiln, the kiln structure and associated facilities must be put into consideration, wherein the building site is a primary factor that may affect greatly the convey time and working efficiency of the light aggregate material, and the plane area occupied by the calcination kiln is also a key point for determination of the building site. Therefore, the way to reduce plane area occupied is an important issue for breaking through the setup constraints in building a calcination kiln.

SUMMARY OF THE INVENTION

This invention is a rotary kiln for calcination of light aggregate cement, wherein a U-turn coupling is adopted for cutting down about half length of a linear calcination kiln to reduce area occupied; a feeding entrance is positioned higher than a product exit; a plurality of revolving segments provided to the rotary kiln body is tapered in caliber gradually to realize a uniform calcination process and save space.

The primary object of this invention is to provide a rotary kiln for calcination of light aggregate cement by taking the advantage of a U-turn kiln body to thereby significantly reduce the area occupied, the production cost, and delivery time of the aggregate material.

Another object of this invention is to provide a rotary kiln for calcination of light aggregate cement, wherein a plurality of revolving segments is varied in caliber gradually to obtain a high calcination efficiency.

For more detailed information regarding advantages or features of this invention, at least an example of preferred embodiment will be elucidated below with reference to the annexed drawings.

DETAILED DESCRIPTION OF THE INVENTION

Figure 1:
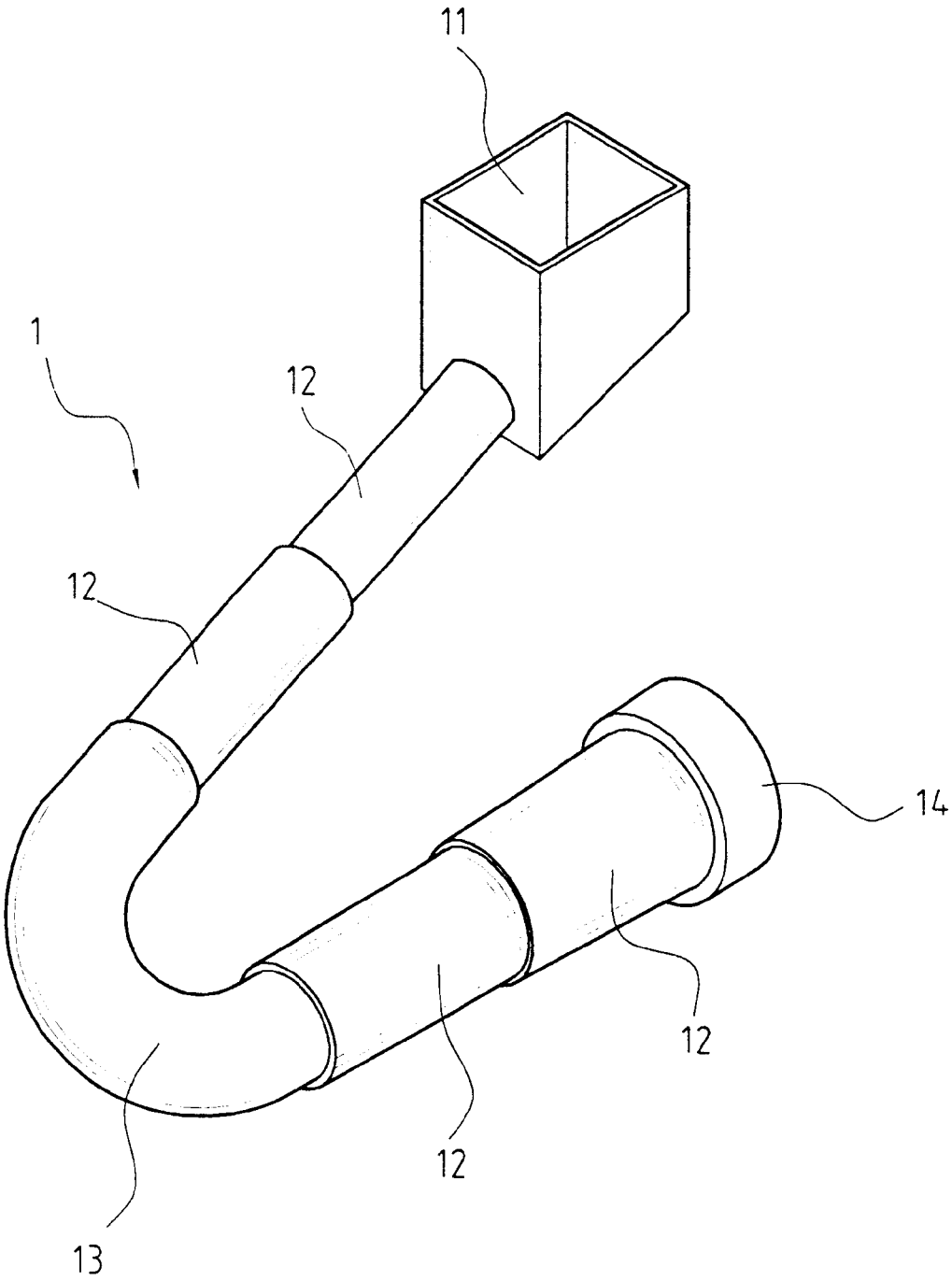
FIG. 1 is a schematic view showing an embodiment of this invention in three dimensions.
Figure 2:
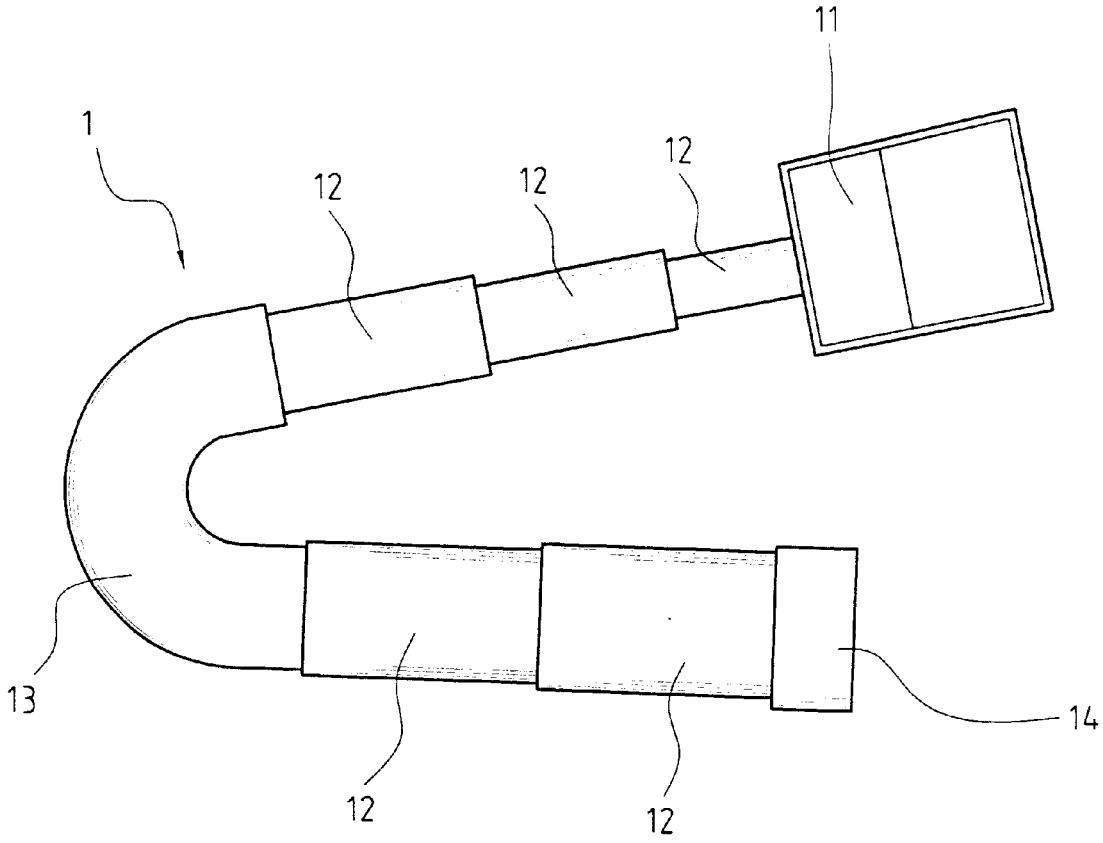
FIG. 2 is a schematic top view of an embodiment of this invention.
Figure 3:
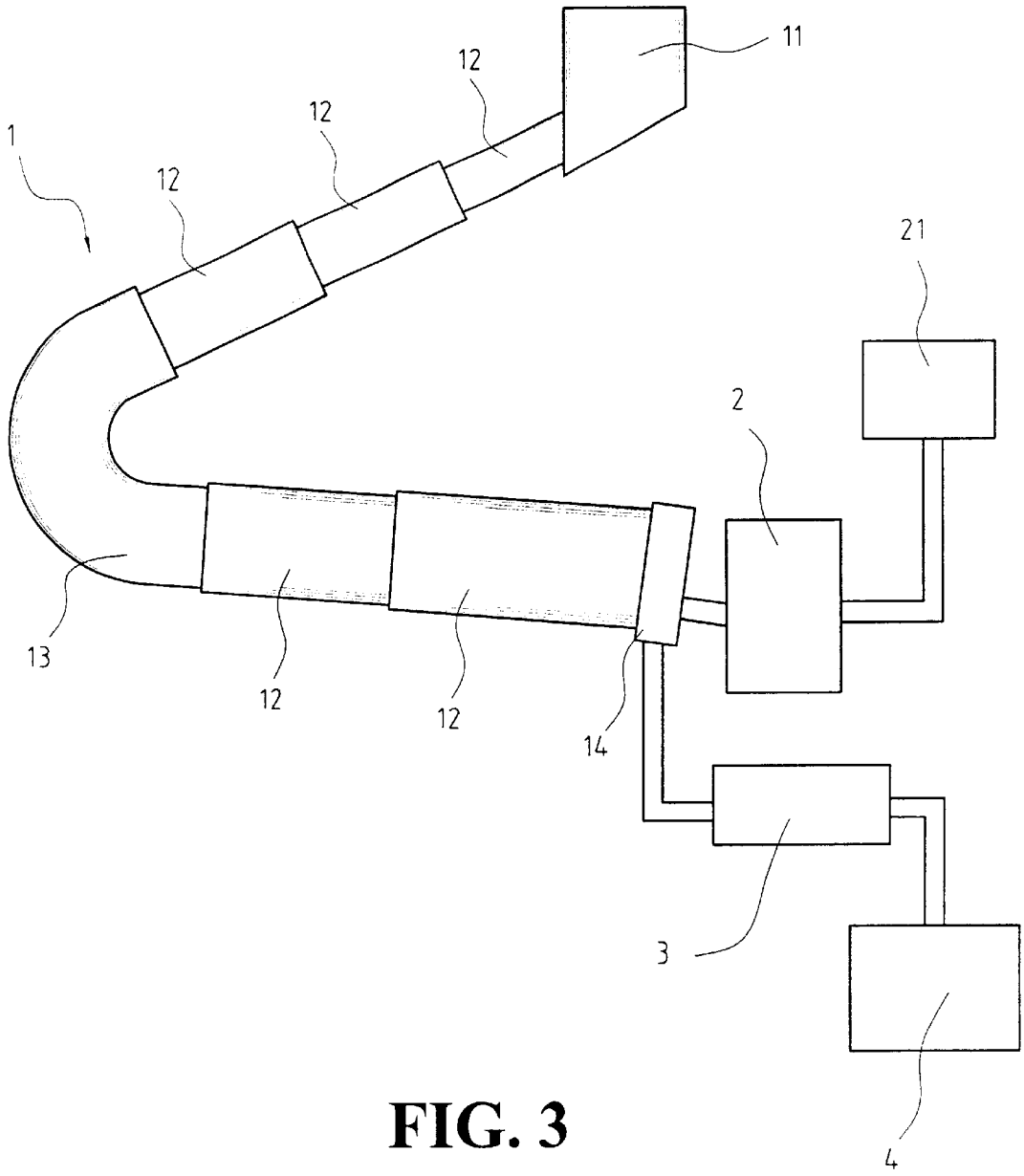
FIG. 3 is a lateral view of an embodiment of this invention.

As indicated in FIGS. 1 through 3, a rotary kiln for calcination of light aggregate cement comprises a calcination kiln body (1), a heavy-oil combustion device (2), and a cooling device (3), wherein the calcination kiln body (1) is a U-turn architecture comprising a feeding entrance (11) at its upmost end, then in sequence a plurality of revolving segments (12), a U-turn coupling (13), again a plurality of revolving segments (12), and a product exit (14) at its lowest end.

The heavy oil combustion device (2) and a heavy oil provider (21) are connected to the product exit (14). The revolving segments (12) are varied in caliber gradually for heightening its efficiency, and in this case, they are gradually reduced from the product exit (14) all the way up to the feeding entrance (11), namely, the diameter of the revolving segment (12) connected with the feeding entrance (11) is the shortest.

When heavy oil is burnt from the heavy oil combustion device (2) towards the calcination kiln body (1), thermal energy is inevitably consumed during transmission, however, combustion can be spread evenly and economically through the entire calcination kiln body (1) to achieve a uniform combustion effect based on the tapered design of the revolving segments (12).

After the light aggregate material is continuously fed through the feeding entrance (11) at the top end, calcination starts in the upmost revolving segment (12) at a predetermined temperature and spreads gradually all the way down to the lowest revolving segment (12) with the largest caliber, and to be collected at the product exit (14).

The output light aggregate material is then cooled by a cooling device (3) located under and coupled with the product exit (14) for strengthening the calcined material before being delivered to a storage tank (4).

Figure 4:
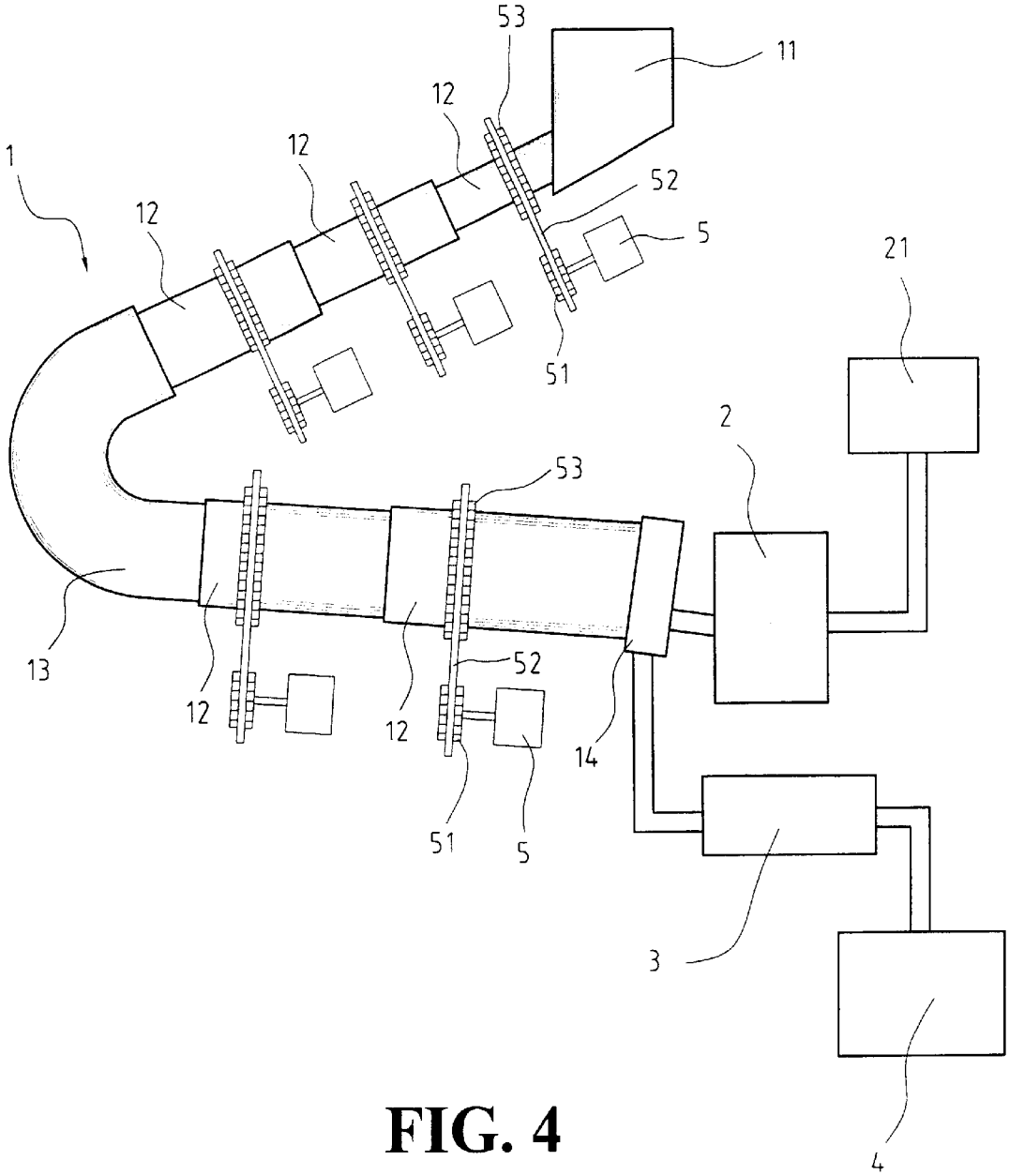
FIG. 4 is the operation instruction of an embodiment of this invention.

Referring to FIG. 4, in the calcination kiln body (1) of this invention, a U-turn coupling (13) is an immobile component and each revolving segment (12) is equipped with a gear wheel (53) connected to another gear wheel (51) of a motor (5) with a chain (52), wherein the motor (5) is powered to drive the revolving segments (12) to rotate respectively.

By taking advantage of the U-turn arrangement of the calcination kiln body (1) and the tapered design of the revolving segment (12) of this invention, the plane area occupied of a calcination kiln is significantly reduced and an economic uniform calcination process is realized.

In the above described, at least one preferred embodiment has been described in detail with reference to the drawings annexed, and it is apparent that numerous variations or modifications may be made without departing from the true spirit and scope thereof, as set forth in the claims below.

What is claimed is:

1. A rotary kiln for calcination of light aggregate cement, comprising a calcination kiln body, a heavy-oil combustion device, and a cooling device, wherein said calcination kiln body is formed in a U-turn configuration having:

an upmost end and a lowest end;

a feeding entrance located at said upmost end;

a U-turn coupling;

a first plurality of sequentially coupled revolving segments extended from said upmost end to said U-turn coupling;

a second plurality of sequentially coupled revolving segments extended from said U-turn coupling to said lowest end; and a product exit located at said lowest end.

2. A rotary kiln according to claim 1, wherein said first and second plurality of sequentially coupled revolving segments of said calcination kiln body are varied in caliber by segment to facilitate calcination.

3. A rotary kiln according to claim 1, wherein the caliber of said first and second plurality of sequentially coupled revolving segments are gradually enlarged by segment from said upmost end to said lowest end of said calcination kiln body.

4. A rotary kiln according to claim 1 wherein said U-turn coupling is immobile and each segment of said first and second plurality of sequentially coupled revolving segments includes a first gear wheel connected via a chain to a gear wheel of a motor, wherein said motor rotates its respective revolving segment.

5. A rotary kiln according to claim 2 wherein said U-turn coupling is immobile and each segment of said first and second plurality of sequentially coupled revolving segments includes a first gear wheel connected via a chain to a gear wheel of a motor, wherein said motor rotates its respective revolving segment.

6. A rotary kiln according to claim 3 wherein said U-turn coupling is immobile and each segment of said first and second plurality of sequentially coupled revolving segments includes a first gear wheel connected via a chain to a gear wheel of a motor, wherein said motor rotates its respective revolving segment.

* * * * *